US008950094B2

(12) United States Patent
Kohn et al.

(10) Patent No.: US 8,950,094 B2
(45) Date of Patent: Feb. 10, 2015

(54) TRADING CARD WITH SLOTS FOR INTERCHANGEABLE INSERTS

(71) Applicant: The Upper Deck Company, Cheyenne, NV (US)

(72) Inventors: Gregg Kohn, Murrieta, CA (US); Michael Eggleston, Carlsbad, CA (US)

(73) Assignee: The Upper Deck Company, Cheyenne, NV (US)

( * ) Notice: Subject to any disclaimer, the term of this patent is extended or adjusted under 35 U.S.C. 154(b) by 5 days.

(21) Appl. No.: 13/901,365

(22) Filed: May 23, 2013

(65) Prior Publication Data

US 2013/0333256 A1 Dec. 19, 2013

Related U.S. Application Data

(60) Provisional application No. 61/653,934, filed on May 31, 2012, provisional application No. 61/673,511, filed on Jul. 19, 2012.

(51) Int. Cl.
*G09F 11/00* (2006.01)
*B42D 15/04* (2006.01)

(52) U.S. Cl.
CPC ..... *B42D 15/045* (2013.01)
USPC ..... 40/490; 40/618; 40/488

(58) Field of Classification Search
USPC ..... 206/39, 39.5, 39.36, 307, 307.1, 308.1, 206/446, 815; 40/488, 489, 490, 491, 618
See application file for complete search history.

(56) References Cited

U.S. PATENT DOCUMENTS

| | | | | |
|---|---|---|---|---|
| 953,953 | A * | 4/1910 | Inglee | 206/39.3 |
| 2,262,058 | A * | 11/1941 | Sinclair | 40/649 |
| 2,540,718 | A * | 2/1951 | Duskin | 40/651 |
| 4,676,628 | A * | 6/1987 | Asbury, III | 355/38 |
| 5,938,010 | A * | 8/1999 | Osterbye | 206/38 |
| 6,671,988 | B2 * | 1/2004 | Cyrluk | 40/617 |
| 7,757,847 | B2 * | 7/2010 | Tang et al. | 206/307.1 |

* cited by examiner

*Primary Examiner* — Casandra Davis
(74) *Attorney, Agent, or Firm* — Roeder & Broder LLP

(57) ABSTRACT

A trading card (10) that is collectible by one or more users comprises a card body (12) and a first card insert (20). The card body (12) includes a first side (14), an opposed second side (16), and a first slot region (18A) that is formed into at least one of the first side (14) and the second side (16). The first card insert (20) is selectively positioned within the first slot region (18A). Additionally, the trading card (10) can further comprise a second card insert (20) that is selectively and alternatively positioned within the first slot region (18A). The card body (12) can further include a second slot region (18B). Each of the card inserts (20) can be interchangeably positioned within one of the first slot region (18A) and the second slot region (18B).

18 Claims, 5 Drawing Sheets

TRADING CARD WITH SLOTS FOR INTERCHANGEABLE INSERTS

RELATED APPLICATIONS

This application is related to and claims priority on U.S. Provisional Patent Application Ser. No. 61/653,934 filed on May 31, 2012, entitled "TRADING CARD WITH SLOTS FOR INTERCHANGEABLE INSERTS", and U.S. Provisional Patent Application Ser. No. 61/673,511 filed on Jul. 19, 2012, entitled "TRADING CARD WITH SLOTS FOR INTERCHANGEABLE INSERTS". As far as is permitted, the contents of U.S. Provisional Patent Application Ser. Nos. 61/527,921 and 61/673,511 are incorporated herein by reference. Additionally, this application is related to U.S. patent application Ser. No. 12/877,976 filed Sep. 8, 2010, entitled "SHADOW BOX TRADING CARD". As far as is permitted, the contents of U.S. patent application Ser. No. 12/877,976 are incorporated herein by reference.

BACKGROUND

Trading cards are a popular way to collect images and information about athletes and celebrities. Unfortunately, many of the trading cards are manufactured in large quantities and are not very unique. Further, existing trading cards cannot adjust or interchange what is actually shown on the trading card at any given time.

SUMMARY

The present invention is directed toward a trading card that is collectible by one or more users, the trading card comprising a card body and a first card insert. The card body includes a first side, an opposed second side, and a first slot region that is formed into at least one of the first side and the second side. The first card insert is selectively positioned within the first slot region. Additionally, in some embodiments, the trading card further comprises a second card insert that is selectively positioned within the first slot region. In one such embodiment, each of the first card insert and the second card insert can be alternatively positioned within the first slot region.

As provided in detail herein, the trading card is designed to provide one or more interchangeable parts, which can enhance the overall value of the trading card. More particularly, the trading card includes the one or more card inserts that can be freely and selectively interchangeable within one or more slot regions so that the overall features and design of the trading card can be changed by the user or owner of the trading card as desired. Thus, the purpose of the trading card is to allow consumers or users to create their own unique card with autographs or signatures or images of athletes, entertainers, etc. that they specifically want to collect.

In certain embodiments, the card body further includes a second slot region. In such embodiments, the trading card can further comprise a second card insert that is selectively positioned within the second slot region. In one embodiment, the first card insert is interchangeably positioned within one of the first slot region and the second slot region, and the second card insert is interchangeably positioned within the other of the first slot region and the second slot region. Further, in one such embodiment, the first slot region is formed into the first side of the card body and the second slot region is formed into the second side of the card body.

Additionally and/or alternatively, the card body can further include a third slot region and a fourth slot region. In one such embodiment, the trading card further comprises a third card insert and a fourth card insert, wherein (i) the first card insert is selectively positioned within one of the slot regions, (ii) the second card insert is selectively positioned within another of the slot regions, (iii) the third card insert is selectively positioned within still another of the slot regions, and (iv) the fourth card insert is selectively positioned within the remaining of the slot regions.

In some embodiments, the card body includes a card image imprinted thereon, and the first card insert includes an insert image that relates to a subject in the card image. For example, in one such embodiment, the subject in the card image is one of a sports athlete, a celebrity or an entertainer, and the insert image includes a signature of the subject.

Additionally, in certain embodiments, the first slot region includes a back, a cover and a cutout that is positioned substantially between the back and the cover. In such embodiments, the first card insert can be selectively positioned within the cutout between the back and the cover. Moreover, in one such embodiment, the cover is formed from a substantially transparent material.

Further, in one embodiment, the cutout has a cutout thickness, and the first card insert has an insert thickness that is substantially equal to the cutout thickness.

Additionally, the present invention is directed toward a trading card that is collectible by one or more users, the trading card comprising (A) a card body including a first side, an opposed second side, a first slot region that is formed into at least one of the first side and the second side, and a second slot region that is formed into at least one of the first side and the second side; (B) a first card insert that is selectively positioned within one of the first slot region and the second slot region; and (C) a second card insert that is selectively positioned within the other of the first slot region and the second slot region.

Further, the present invention is also directed toward a trading card that is collectible by one or more users, the trading card comprising (A) a card body including (i) a first side, (ii) an opposed second side, (iii) a first slot region that is formed into the first side, (iv) a second slot region that is formed into the second side, (v) a first card image that is imprinted on the first side, the first card image including a first subject, and (vi) a second card image that is imprinted on the second side, the second card image including a second subject; (B) a first card insert that is selectively positioned within one of the first slot region and the second slot region, the first card insert including a first insert image that relates to at least one of the first subject and the second subject; and (C) a second card insert that is selectively positioned within the other of the first slot region and the second slot region, the second card insert including a second insert image that relates to at least one of the first subject and the second subject.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
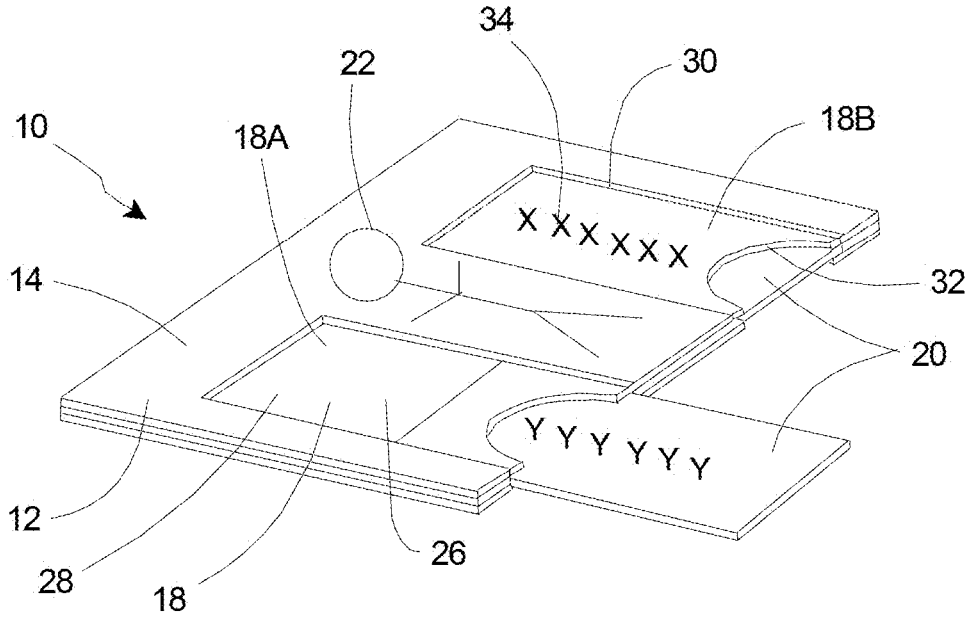
FIG. 1A is a perspective view of an embodiment of a trading card having features of the present invention.
Figure 1B:
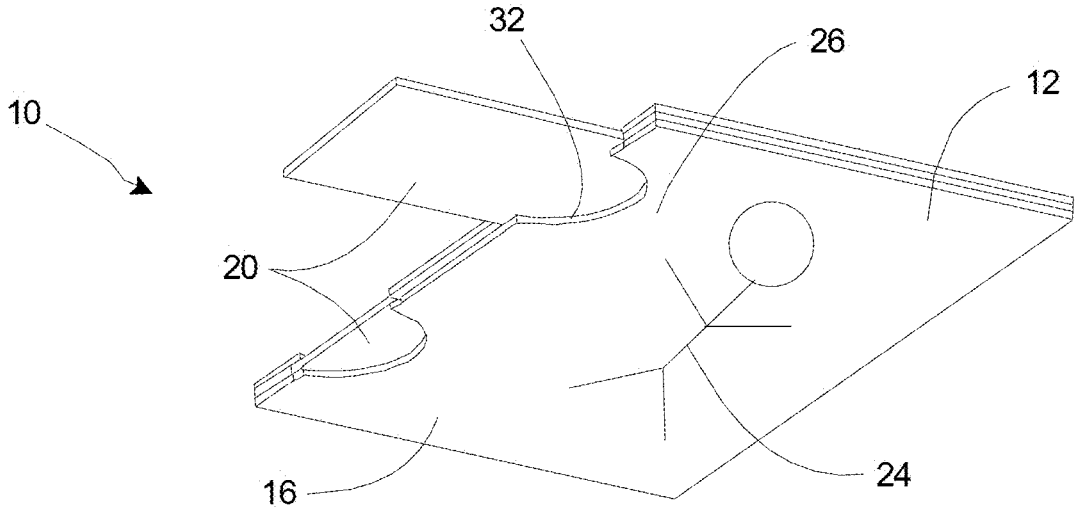
FIG. 1B is another perspective view of the trading card of FIG. 1A.

FIG. 1A is a perspective view of an embodiment of a trading card 10 having features of the present invention. Additionally, FIG. 1B is another perspective view of the trading card 10 illustrated in FIG. 1A. As utilized herein, the term "trading card" means one of a set of small cards with a picture or design printed on it, which is intended to be collected and traded, especially by children.

The size and shape of the trading card 10 and the various components of the trading card 10 can be varied to suit the desired specific design requirements of the trading card 10. In some embodiments, the trading card 10 is generally rectangular shaped and has a length of between approximately 2.0 and 6.0 inches, a width of between approximately 1.5 and 4.0 inches, and a thickness of between approximately 0.05 and 0.50 inches. For example, the trading card 10 can have the same approximate cross-sectional area of a standard trading card having a length of approximately 3.5 inches and a width of approximately 2.5 inches, and can have a thickness of between approximately 0.0625 and 0.25 inches. Alternatively, the trading card 10 can have a different shape and/or have a different size. In certain embodiments, for example, the trading card 10 can be generally square shaped, circle shaped, oval shaped, hexagon shaped, or some other shape, and/or the trading card 10 can have dimensions that are greater than or less than those provided above.

As shown in the embodiment illustrated in FIGS. 1A and 1B, the trading card 10 includes a card body 12 having a first side 14, an opposed second side 16 and one or more slot regions 18, and one or more card inserts 20. In particular, FIG. 1A is a perspective view of the first side 14 of the trading card 10, and FIG. 1B is a perspective view of the second side 16 of the trading card 10.

As an overview, the trading card 10, as taught in the present invention, is designed to provide one or more interchangeable parts, which can enhance the overall value of the trading card 10. More particularly, the trading card 10 includes the one or more card inserts 20 that can be freely and selectively interchangeable within the one or more slot regions 18 so that the overall features and design of the trading card 10 can be changed by the user or owner of the trading card 10 as desired. Thus, the purpose of the trading card 10 is to allow consumers or users to create their own unique card with autographs or signatures or images of athletes, entertainers, etc. that they specifically want to collect. This puts the power in the hands of the consumer.

Since, as illustrated, the card body 12 can form a majority of the trading card 10, it should be appreciated that the general size and shape of the card body 12 can be substantially the same as the overall size and shape of the trading card 10. For example, in some embodiments, the card body 12 can be generally rectangular shaped and can have a size that is similar to the size of a standard trading card, e.g., such as described above. Alternatively, the card body 12 can be designed to have a different shape and/or a different size.

Additionally, in some embodiments, the card body 12 can be made from card stock. Alternatively, the card body 12 can be made from a material other than card stock.

In certain embodiments, as shown in FIG. 1A, the first side 14 of the card body 12 can have a first card image 22 that is positioned thereon. In different embodiments, the first card image 22 can cover some, most, or substantially the entire available surface of the first side 14 of the card body 12, and can be positioned at any location on the surface of the first side 14. In certain non-exclusive examples, the first card image 22 can include one or more of a sports athlete, a celebrity, an entertainer, statistics, a team logo, a game field or arena, an image used in a game, an animated character or characters, an autograph or signature, an animal or a landscape.

Somewhat similarly, in certain embodiments, as shown in FIG. 1B, the second side 16 of the card body 12 can have a second card image 24 that is positioned thereon. In different embodiments, the second card image 24 can cover some, most, or substantially the entire available surface of the second side 16 of the card body 12, and can be positioned at any location on the surface of the second side 16. In certain non-exclusive examples, the second card image 24 can include one or more of a sports athlete, a celebrity, an entertainer, statistics, a team logo, a game field or arena, an image used in a game, an animated character or characters, an autograph or signature, an animal or a landscape.

It should be noted that the use of the terms first side and second side are used merely for reasons of convenience of description, and either of the sides 14, 16 can be considered to be the first side or the second side. Somewhat similarly, it should be noted that the use of the terms first card image and second card image are used merely for reasons of convenience of description, and either of the card images 22, 24 can be considered to be the first card image or the second card image.

In certain embodiments, the one or more slot regions 18 can be cut out of and/or formed into the first side 14 and/or the second side 16 of the card body 12. Additionally, the one or more slot regions 18 can be sized and shaped to interchangeably and alternatively receive and retain some or all of the one or more card inserts 20. In the embodiment illustrated in FIGS. 1A and 1B, the trading card 10 includes two slot regions 18, i.e. a first slot region 18A and a second slot region 18B, so that any two card inserts 20 can be positioned within the slot regions 18 at any given time, i.e. with one card insert 20 positioned within each of the first slot region 18A and the second slot region 18B. Alternatively, the trading card 10 can be designed to include a different number of slot regions 18. For example, in certain alternative embodiments, the trading card 10 can be designed to include only one slot region 18, or the trading card 10 can be designed to include three, four, five, six, or another suitable number of slot regions 18.

It should be noted that the use of the terms first slot region and second slot region are used merely for reasons of convenience of description, and any of the slot regions 18 can be considered to be the first slot region or the second slot region.

The design of each of the slot regions 18 can be varied. As illustrated in this embodiment, each slot region 18 can be substantially similar in design. For example, as shown in the embodiment illustrated in FIG. 1A, each slot region 18 can include a back 26, a cover 28 and a cutout 30 that is positioned between the back 26 and the cover 28 of the slot region 18. Alternatively, one or more of the slot regions 18 can have a design that is different than that of the other slot regions 18. For example, one or more of the slot regions 18 can be designed without a cover 28.

In certain embodiments, as shown in FIG. 1B, the back 26 of each slot region 18 can be integral with and form a part of the second side 16 of the card body 12. In such embodiments, the back 26 and the second side 16 can cooperate to enable a substantially smooth overall surface along the second side 16 of the card body 12. Alternatively, the back 26 of each slot region 18 can be formed separately from the second side 16 of the card body 12. In such alternative embodiments, the back 26 can be positioned at approximately the same level as the second side 16 of the card body 12 to enable a substantially smooth overall surface along the second side 16 of the card body; or the back 26 can be positioned at a slightly different level than the second side 16 of the card body 12.

The cover 28 is positioned over the cutout 30 of the slot region 18. Additionally, in some embodiments, the cover 28 can be made of a substantially transparent material to enable the user to view what is positioned within the cutout 30 of the slot region 18. For example, in certain embodiments, the cover 28 of each of the slot regions 18 can be made from PVC, clear plastic or some other transparent material. With this design, one of the one or more card inserts 20 may be selectively and alternatively positioned within the cutout 30 by the user, and the transparent cover 28 enables the user to view the card insert 20 within the cutout 30 of the slot region 18.

Moreover, in one embodiment, the cover 28 can be positioned at approximately the same level as the first side 14 of the card body 12 to enable a substantially smooth overall surface along the first side 14 of the card body 12. Alternatively, the cover 28 can be positioned at a slightly different level than the first side 14 of the card body 12.

As noted above, the cutout 30 can be positioned at least substantially between the back 26 and the cover 28 of the slot region 18. Additionally, in some embodiments, the cutout 30 can be cut out of and/or formed into the first side 14 and/or the second side 16 of the card body 12. For example, the cutout 30 can be formed within the card body 12 by removing some material that would otherwise comprise a portion of the card body 12. In some embodiments, the cutout 30 can be sized and shaped, i.e. can have a length, width and thickness, to interchangeably and alternatively receive and retain any of the one or more card inserts 20. Alternatively, the cutout 30 can be sized and shaped to interchangeably and alternatively receive and retain fewer than all of the one or more card inserts 20.

Additionally, as shown in the embodiment illustrated in FIG. 1A, the slot regions 18, i.e. the back 26, the cover 28 and the cutout 30, can be substantially rectangular shaped. Alternatively, the slot regions 18 can have a different shape. For example, the slot regions 18 can be substantially square shaped, or some other shape. Moreover, each of the slot regions 18 can have the same size and shape as one another, or one or more of the slot regions 18 can have a size and shape that is different than the other slot regions 18.

Further, as illustrated, the back 26 and the cover 28 can each include a notch 32 so as to enable the user to easily grasp the card insert 20 when the card insert 20 is positioned within the cutout 30 of the slot region 18. With this design, at least a portion of the card insert 20 is not covered by the back 26 and the cover 28. Alternatively, in certain embodiments, only one of the back 26 and the cover 28 can include such a notch 32, or neither the back 26 nor the cover 28 can include such a notch 32.

As shown in FIGS. 1A and 1B, the one or more card inserts 20 are sized and shaped to slide and fit snugly within at least one of the one or more slot regions 18, i.e. within at least one of the cutouts 30 of the slot regions 18. More particularly, in some embodiments, the card inserts 20 can be substantially rectangular shaped, and the length, width and thickness of the card inserts 20 can be varied depending on the size of the cutouts 30. For example, in certain embodiments, the card inserts 20 can have a length, a width, and/or a thickness that is slightly smaller than and substantially equal to the length, the width and/or the thickness of the cutout 30, respectively. With this design, the card inserts 20 can fit snugly and be retained securely within the cutouts 30 of the slot regions 18.

Further, in this embodiment, each of the card inserts 20 can alternatively and selectively be positioned within the first slot region 18A and/or the second slot region 18B. With the design as provided herein, the card inserts 20 can be easily and effectively retained within the slot regions 18 such that the card inserts 20 will not simply slide out of the slot regions 18 when such movement is not desired. Additionally, with such design, the overall appearance of the trading card 10 can be varied as desired by selectively changing the particular card inserts 20 that are positioned within the slot regions 18 at any given time.

Additionally, it should be noted that any suitable number of card inserts 20 can be included with any given trading card 10. In one embodiment, the number of card inserts 20 can be the same as the number of slot regions 18 in the card body 12. Alternatively, the number of card inserts 20 included with the trading card 10 can be different than the number of slot regions 18. For example, in certain non-exclusive embodiments, for a trading card 10 having a card body 12 with two slot regions 18, the trading card 10 can include three, four, five, six, seven or eight card inserts 20. With a larger number of card inserts 20, the user or owner of the trading card 10 has greater latitude in determining the specific design that is desired for the trading card 10 at any given time.

Further, each of the card inserts 20 can include an insert image 34 that is positioned on the card insert 20. In certain non-exclusive examples, the insert image 34 can include one or more of a sports athlete, a celebrity, an entertainer, statistics, a team logo, a game field or arena, an image used in a game, an animated character or characters, an autograph or signature, an animal or a landscape.

Still further, in some embodiments, the card inserts 20 can be substantially rectangular shaped and can be made from card stock. Alternatively, the card inserts 20 can have a different shape and/or can be made from a material other than card stock. For example, the card inserts 20 can be substantially square shaped, or some other shape. Moreover, each of the card inserts 20 can be of the same size and shape as one another such that any of the card inserts 20 can fit within any of the cutouts 30 of the slot regions 18, or one or more of the card inserts 20 can have a size and shape that is different than the other card inserts 20 such that only certain card inserts 20 can fit within certain cutouts 30 of the slot regions 18.

In one specific embodiment, the first card image 22 on the first side 14 of the card body 12 and/or the second card image 24 on the second side 16 of the card body 12 can be an image of one or more sports athletes, celebrities or entertainers; and the insert images 34 on the card inserts 20 can be autographs or signatures of the sports athletes, celebrities or entertainers that are included within the first card image 22 and/or the second card image 24. With this design, the consumer can specifically determine which signature (or signatures) is included with the trading card 10 at any given time. This idea differs from all other signed trading cards found within the trading card industry in that it would be the only one to allow people to choose which of the interchangeable signatures they want to be included as part of the trading card 10 by making the card inserts 20, with the signature(s) imprinted thereon, removable from the slot regions 18. In other words, the trading card 10 of the present invention would be an industry first in that the trading cards 10 have multiple interchangeable pieces, e.g., signature card inserts, to enhance value.

In certain alternative embodiments, the trading cards 10 can be not only used with interchangeable autographs or signatures, but can also be used with interchangeable images and art as well. For example, other applications of the present invention could be for comic storyboards or images where the card inserts 20 and insert images 34 can be selectively interchanged as desired to alter and/or enhance the story or collectability of the trading card 10. This would allow the trading card 10 to be a living entity, so to speak, by being able to switch in new images or story content.

Figure 2A:
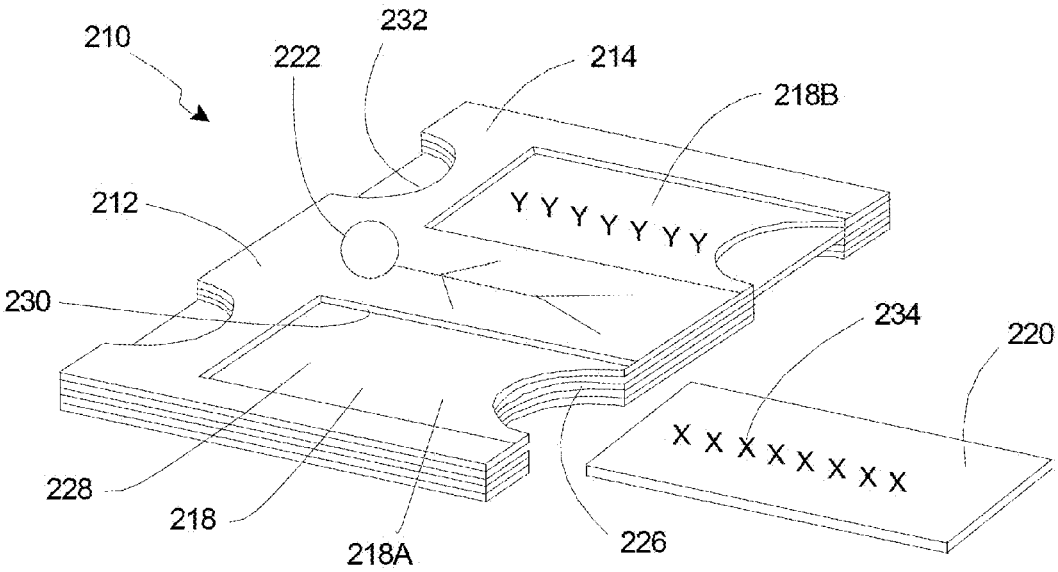
FIG. 2A is a perspective view of another embodiment of a trading card having features of the present invention.
Figure 2B:
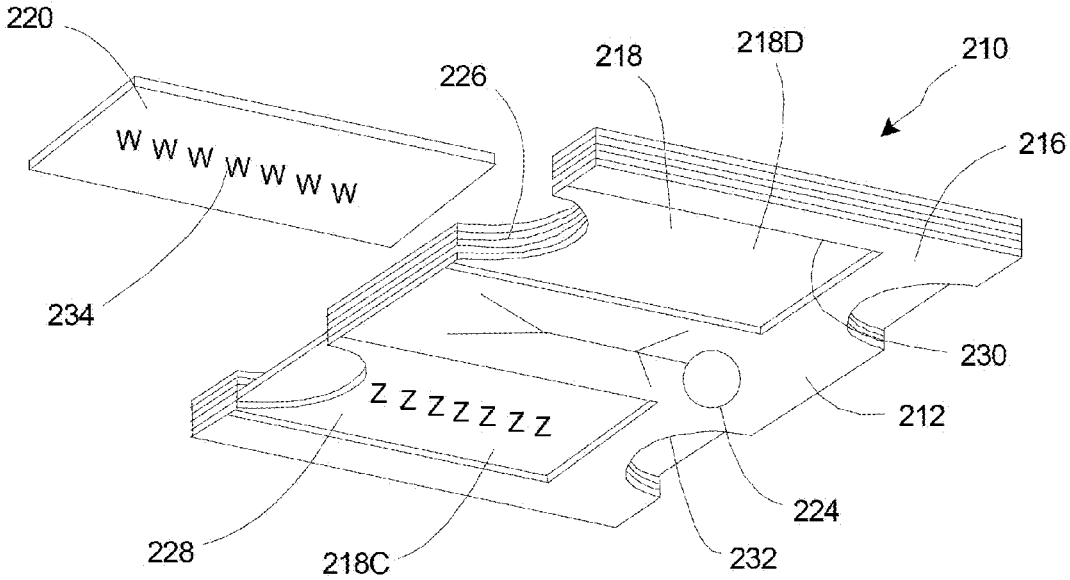
FIG. 2B is another perspective view of the trading card of FIG. 2A.

FIG. 2A is a perspective view of another embodiment of a trading card 210 having features of the present invention. Additionally, FIG. 2B is another perspective view of the trading card 210 illustrated in FIG. 2A. The design of the trading card 210 is somewhat similar to the design of the trading card 10 illustrated and described above in relation to FIGS. 1A and 1B. In particular, in some embodiments, the trading card 210 is again generally rectangular shaped and has a length of between approximately 2.0 and 6.0 inches, a width of between approximately 1.5 and 4.0 inches, and a thickness of between approximately 0.05 and 0.50 inches. For example, the trading card 210 can have the same approximate cross-sectional area of a standard trading card having a length of approximately 3.5 inches and a width of approximately 2.5 inches, and can have a thickness of between approximately 0.0625 and 0.25 inches. Alternatively, the trading card 210 can have a different shape and/or have a different size. In certain embodiments, for example, the trading card 210 can be generally square shaped, circle shaped, oval shaped, hexagon shaped, or some other shape, and/or the trading card 210 can have dimensions that are greater than or less than those provided above.

Additionally, as shown in the embodiment illustrated in FIGS. 2A and 2B, the trading card 210 includes a card body 212 having a first side 214, an opposed second side 216 and one or more slot regions 218, and one or more card inserts 220. As illustrated, FIG. 2A is a perspective view of the first side 214 of the trading card 210, and FIG. 2B is a perspective view of the second side 216 of the trading card 210.

In this embodiment, the first side 214 of the card body 212 can again have a first card image 222 that is positioned thereon. In different embodiments, the first card image 222 can cover some, most, or substantially the entire available surface of the first side 214 of the card body 212, and can be positioned at any location on the surface of the first side 214. In certain non-exclusive examples, the first card image 222 can include one or more of a sports athlete, a celebrity, an entertainer, statistics, a team logo, a game field or arena, an image used in a game, an animated character or characters, an autograph or signature, an animal or a landscape.

Somewhat similarly, in this embodiment, the second side 216 of the card body 212 can again have a second card image 224 that is positioned thereon. In different embodiments, the second card image 224 can cover some, most, or substantially the entire available surface of the second side 216 of the card body 212, and can be positioned at any location on the surface of the second side 216. In certain non-exclusive examples, the second card image 224 can include one or more of a sports athlete, a celebrity, an entertainer, statistics, a team logo, a game field or arena, an image used in a game, an animated character or characters, an autograph or signature, an animal or a landscape.

In certain embodiments, the one or more slot regions 218 can be cut out of and/or formed into the first side 214 and/or the second side 216 of the card body 212. Additionally, the one or more slot regions 218 can be sized and shaped to interchangeably and alternatively receive and retain some or all of the one or more card inserts 220. In the embodiment illustrated in FIGS. 2A and 2B, the trading card 210 includes four slot regions 218, i.e. a first slot region 218A, a second slot region 218B, a third slot region 218C and a fourth slot region 218D, so that any four card inserts 220 can be positioned within the slot regions 218 at any given time, i.e. with one card insert 220 positioned within each of the first slot region 218A, the second slot region 218B, the third slot region 218C and the fourth slot region 218D. Additionally, as illustrated, the trading card 10 can be designed such that two slot regions 218 are positioned such that two card inserts 220 can be visible within the slot regions 218 on each side 214, 216 of the card body 212 at any given time. Moreover, the two slot regions 218 on the first side 214 can be positioned substantially opposite of the two slot regions 218 positioned on the second side 216. Alternatively, the trading card 210 can be designed to include a different number of slot regions 218. For example, in certain embodiments, the trading card 210 can be designed to include greater than four or less than four slot regions 218.

The design of each of the slot regions 218 can be varied. For example, in this embodiment, the design of each of the slot regions 218 is somewhat similar to the design of the slot regions 18 illustrated and described above in relation to FIGS. 1A and 1B. In particular, each slot region 218 can again include a back 226, a cover 228 and a cutout 230 that are somewhat similar to the back 26, the cover 28 and the cutout 30 illustrated and described above in relation to FIGS. 1A and 1B.

However, in this embodiment, the back 226 of each slot region 218 is positioned somewhat centrally within the card body 212. Moreover, the back 226 for the slot region 218 on one side 214, 216 can also function as the back 226 for a slot region 218 on the other side 216, 214. By way of example, in one embodiment, the back 226 for the first slot region 218A on the first side 214 can also function as the back 226 for the fourth slot region 218D on the second side 216; and the back 226 for the second slot region 218B on the first side 214 can also function as the back 226 for the third slot region 218C on the second side 216.

The cover 228 is again positioned over the cutout 230 of the slot region 218, and can be made of a transparent material to enable the user to view what is positioned within the cutout 230 of the slot region 218. For example, in certain embodiments, the cover 228 of each of the slot regions 218 can be made from PVC, clear plastic or some other transparent material. With this design, one of the one or more card inserts 220 may be selectively and alternatively positioned within the cutout 230 by the user, and the transparent cover 228 enables the user to view the card insert 220 within the cutout 230 of the slot region 218.

In certain embodiments, the cutout 230 can again be cut out of and/or formed into the first side 214 and/or the second side 216 of the card body 212. Additionally, the cutout 230 is again positioned at least substantially between the back 226 and the cover 228 of the slot region 218. In some embodiments, the cutout 230 can be sized and shaped to interchangeably and alternatively receive and retain any of the one or more card inserts 220. Alternatively, the cutout 230 can be sized and shaped to interchangeably and alternatively receive and retain fewer than all of the one or more card inserts 220.

Further, as illustrated, the slot regions 218, i.e. the back 226, the cover 228 and the cutout 230, can be substantially rectangular shaped. Alternatively, the slot regions 218 can have a different shape. For example, the slot regions 218 can be substantially square shaped, or some other shape. Moreover, each of the slot regions 218 can have the same size and shape as one another, or one or more of the slot regions 218 can have a size and shape that is different than the other slot regions 218.

Still further, as illustrated, the back 226 and the cover 228 can each include a notch 232 so as to enable the user to easily grasp the card insert 220 when the card insert 220 is positioned within the cutout 230 of the slot region 218. Alternatively, in certain embodiments, only one of the back 226 and the cover 228 can include such a notch 232, or neither the back 226 nor the cover 228 can include such a notch 232.

As shown, the one or more card inserts 220 are sized and shaped to slide and fit snugly within at least one of the one or more slot regions 218, i.e. within at least one of the cutouts 230 of the slot regions 218. For example, in this embodiment, each of the card inserts 220 can alternatively and selectively be positioned within the first slot region 218A, the second slot region 218B, the third slot region 218C and/or the fourth slot region 218D. With the design as provided herein, the card inserts 220 can be easily and effectively retained within the slot regions 218 such that the card inserts 220 will not simply slide out of the slot regions 218 when such movement is not desired. Additionally, with such design, the overall appearance of the trading card 210 can be varied as desired by selectively changing the particular card inserts 220 that are positioned within the slot regions 218 at any given time.

Additionally, the number of card inserts 220 that are included with the trading card 210 can be varied. In one embodiment, the number of card inserts 220 can be the same as the number of slot regions 218 in the card body 212. Alternatively, the number of card inserts 220 included with the trading card 210 can be different than the number of slot regions 218. For example, in certain non-exclusive embodiments, in a trading card 210 having a card body 212 with four slot regions 218, the trading card 210 can include five, six, seven, eight, nine or ten card inserts 220. With a larger number of card inserts 220, the user or owner of the trading card 210 has greater latitude in determining the specific design that is desired for the trading card 210 at any given time.

Further, each of the card inserts 220 can again include an insert image 234 that is positioned on the card insert 220. In certain non-exclusive examples, the insert image 234 can include one or more of a sports athlete, a celebrity, an entertainer, statistics, a team logo, a game field or arena, an image used in a game, an animated character or characters, an autograph or signature, an animal or a landscape.

Still further, in some embodiments, the card inserts 220 can be substantially rectangular shaped and can be made from card stock. Alternatively, the card inserts 220 can have a different shape and/or can be made from a material other than card stock. For example, the card inserts 220 can be substantially square shaped, or some other shape. Moreover, each of the card inserts 220 can be of the same size and shape as one another such that any of the card inserts 220 can fit within any of the cutouts 230 of the slot regions 218, or one or more of the card inserts 220 can have a size and shape that is different than the other card inserts 220 such that only certain card inserts 220 can fit within certain cutouts 230 of the slot regions 218.

Additionally, in one specific embodiment, the first card image 222 on the first side 214 of the card body 212 and/or the second card image 224 on the second side 216 of the card body 212 can be an image of one or more sports athletes, celebrities or entertainers, and the insert images 234 on the card inserts 220 can be autographs or signatures of the sports athletes, celebrities or entertainers that are included within the first card image 222 and/or the second card image 224. With this design, the consumer can specifically determine which signature (or signatures) is included with the trading card 210 at any given time.

In certain alternative embodiments, the trading cards 210 can be not only used with interchangeable autographs or signatures, but can also be used with interchangeable images and art as well. For example, other applications of the present invention could be for comic storyboards or images where the card inserts 220 and insert images 234 can be selectively interchanged as desired to alter and/or enhance the story or collectability of the trading card 210.

Figure 3A:
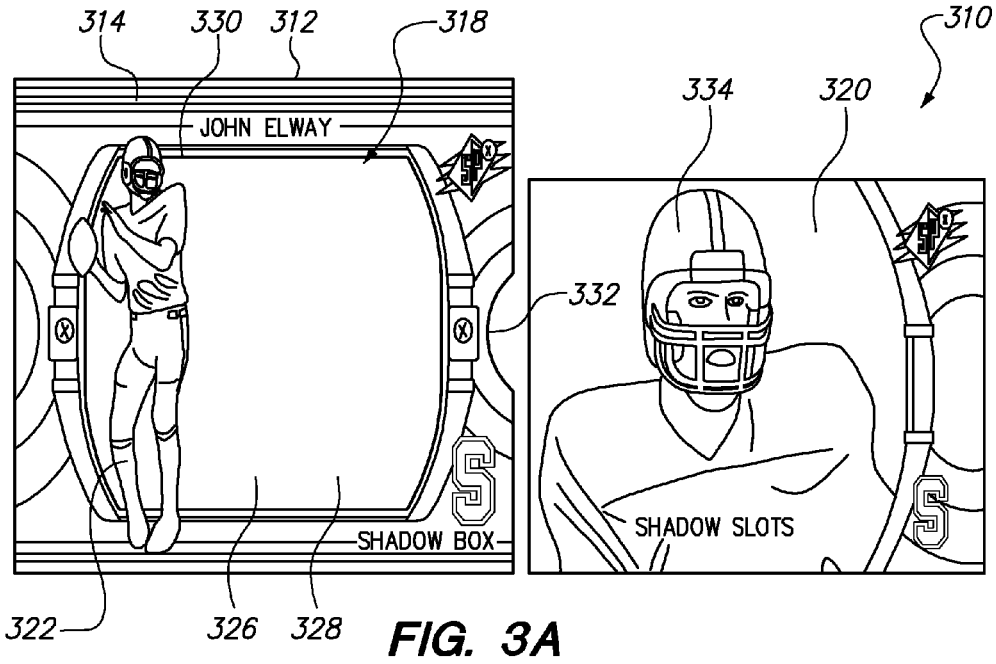
FIG. 3A is a partially exploded front view of still another embodiment of a trading card having features of the present invention, the trading card including a card body and a card insert that is positioned outside the card body.

FIG. 3A is a partially exploded front view of still another embodiment of a trading card 310 having features of the present invention. The design of the trading card 310 is somewhat similar to the design of the trading cards 10, 210 illustrated and described above in relation to FIGS. 1A-1B and FIGS. 2A-2B, respectively. For example, as illustrated, the trading card 310 again includes a card body 312 having a first side 314, an opposed second side 316 (illustrated in FIG. 3B) and a slot region 318, and one or more card inserts 320 (only one is illustrated in FIG. 3A). Additionally, in this embodiment, the slot region 318 has a size and shape such that the one or more card inserts 320 can be selectively and alternatively positioned within the slot region 318. In FIG. 3A, the card insert 320 is positioned spaced apart from and/or outside the card body 312, i.e. the card insert 320 is not yet positioned within the slot region 318.

As above, in some embodiments, the trading card 310 can be generally rectangular shaped and can have a length of between approximately 2.0 and 6.0 inches, a width of between approximately 1.5 and 4.0 inches, and a thickness of between approximately 0.05 and 0.50 inches. For example, the trading card 310 can have the same approximate cross-sectional area of a standard trading card having a length of approximately 3.5 inches and a width of approximately 2.5 inches, and can have a thickness of between approximately 0.0625 and 0.25 inches. Alternatively, the trading card 310 can have a different shape and/or have a different size. In certain embodiments, for example, the trading card 310 can be generally square shaped, circle shaped, oval shaped, hexagon shaped, or some other shape, and/or the trading card 310 can have dimensions that are greater than or less than those provided above.

As noted above, FIG. 3A illustrates a front view, i.e. showing the first side 314, of the trading card 310. In this embodiment, the first side 314 of the card body 312 can again have a first card image 322 that is positioned thereon. In different embodiments, the first card image 322 can cover some, most, or substantially the entire available surface of the first side 314 of the card body 312, and can be positioned at any location on the surface of the first side 314. In certain non-exclusive examples, the first card image 322 can include one or more of a sports athlete, a celebrity, an entertainer, statistics, a team logo, a game field or arena, an image used in a game, an animated character or characters, an autograph or signature, an animal or a landscape.

Figure 3B:
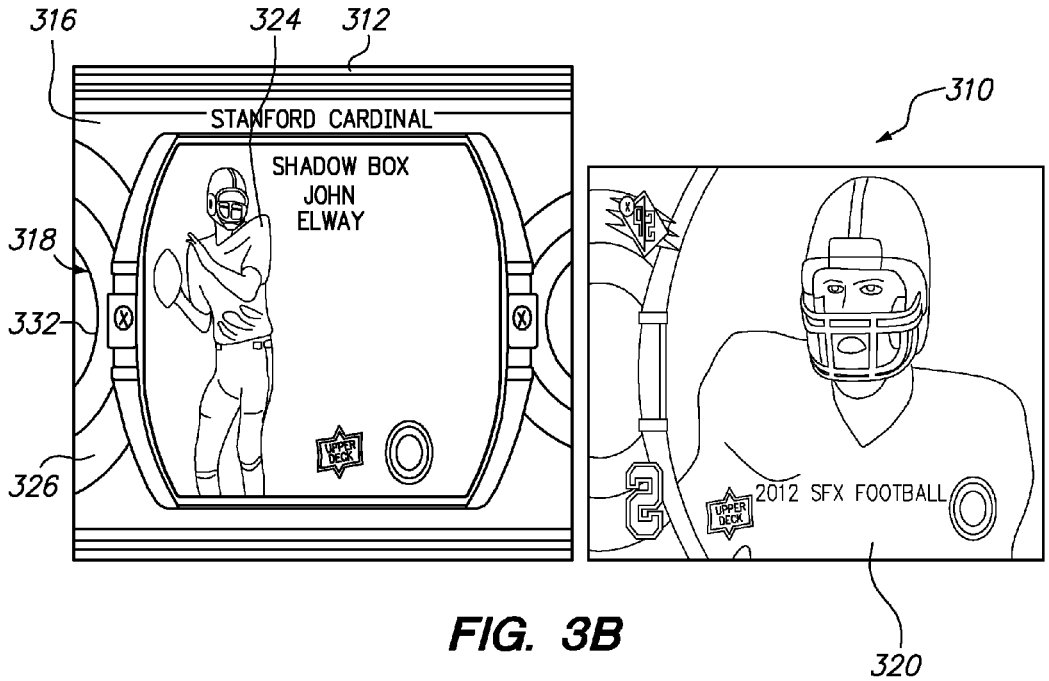
FIG. 3B is a partially exploded back view of the trading card of FIG. 3A, with the card insert being positioned outside the card body.

FIG. 3B is a partially exploded back view of the trading card 310 of FIG. 3A. More particularly, FIG. 3B provides a view of the second side 316 of the card body 312 of the trading card 310. As shown in FIG. 3B, the card insert 320 is again illustrated as being positioned spaced apart from and/or outside the card body 312. As with the previous embodiments, the second side 316 of the card body 312 can again have a second card image 324 that is positioned thereon. In different embodiments, the second card image 324 can cover some, most, or substantially the entire available surface of the second side 316 of the card body 312, and can be positioned at any location on the surface of the second side 316. In certain non-exclusive examples, the second card image 324 can include one or more of a sports athlete, a celebrity, an entertainer, statistics, a team logo, a game field or arena, an image used in a game, an animated character or characters, an autograph or signature, an animal or a landscape.

Returning to FIG. 3A, as noted above, the slot region 318 can be sized and shaped to interchangeably and alternatively receive and retain some or all of the one or more card inserts 320. Alternatively, the trading card 310 can be designed to include more than one slot region 318.

The design of the slot region 318 is somewhat similar to the design of the slot regions 18, 218 illustrated and described above. In particular, the slot region 318 can again include a back 326, a cover 328 and a cutout 330 (illustrated more clearly in FIG. 3D) that are somewhat similar to the backs 26, 226, the covers 28, 228, and the cutouts 30, 230 illustrated and described above.

As illustrated in FIG. 3B, the back 326 of the slot region 318 can be integral with and form a part of the second side 316 of the card body 312. Alternatively, the back 326 of the slot region 318 can be formed separately from the second side 316 of the card body 312.

Additionally, as shown in FIG. 3A, the cover 328 is again positioned over the cutout 330 of the slot region 318, and at least a portion of the cover 328 can be made of a transparent material to enable the user to view what is positioned within the cutout 330 of the slot region 318. For example, one of the one or more card inserts 320 may be selectively and alternatively positioned within the cutout 330 by the user, and the transparent cover 328 enables the user to view the card insert 320 within the cutout 330 of the slot region 318.

Further, the cutout 330 is positioned between the back 326 and the cover 328 of the slot region 318. In some embodiments, the cutout 330 can be sized and shaped to interchangeably and alternatively receive and retain any of the one or more card inserts 320. Alternatively, the cutout 330 can be sized and shaped to interchangeably and alternatively receive and retain fewer than all of the one or more card inserts 320.

Still further, in certain embodiments, the slot region 318, i.e. the back 326, the cover 328 and the cutout 330, can be substantially rectangular shaped. Alternatively, the slot region 318 can have a different shape. For example, the slot region 318 can be substantially square shaped, or some other shape.

Figure 3C:
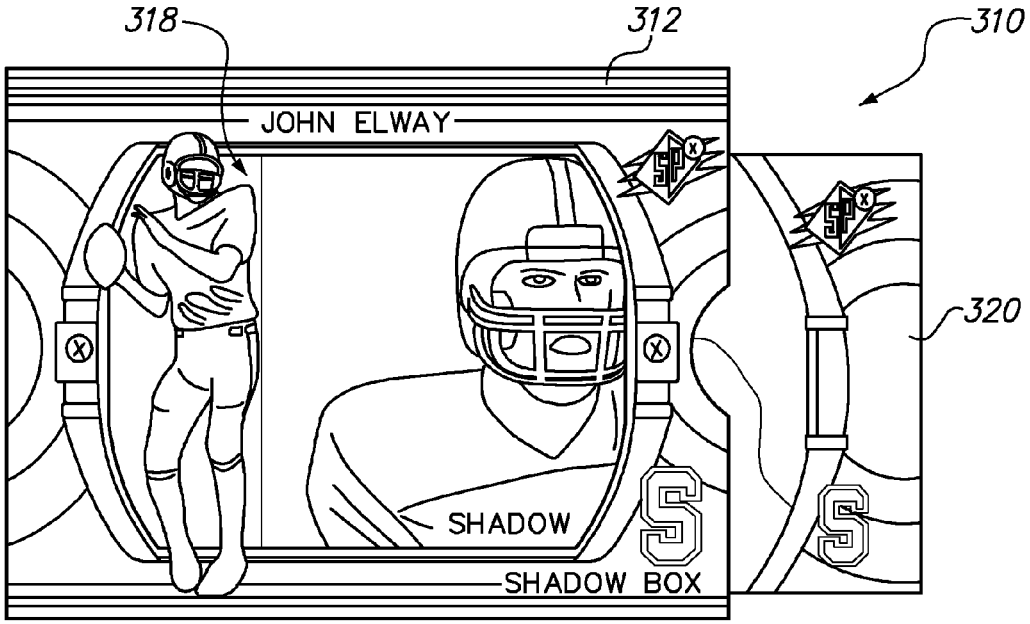
FIG. 3C is a front view of the trading card of FIG. 3A, with the card insert positioned partially within the card slot.
Figure 3D:
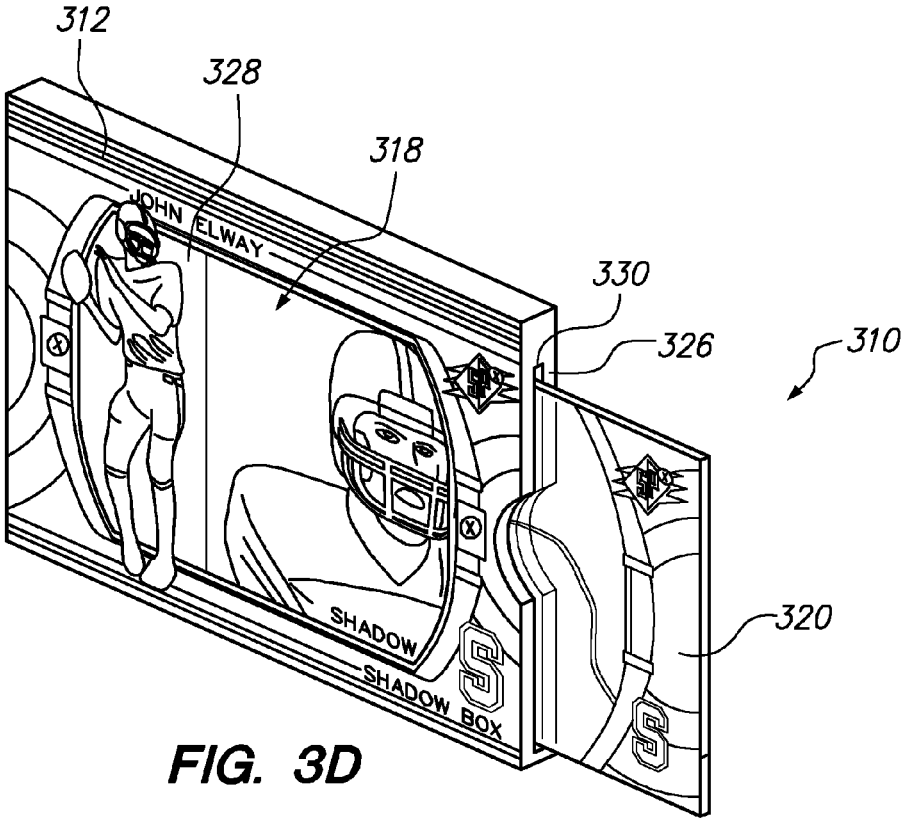
FIG. 3D is a perspective view of the trading card of FIG. 3A, with the card insert positioned partially within the card slot.
Figure 3E:
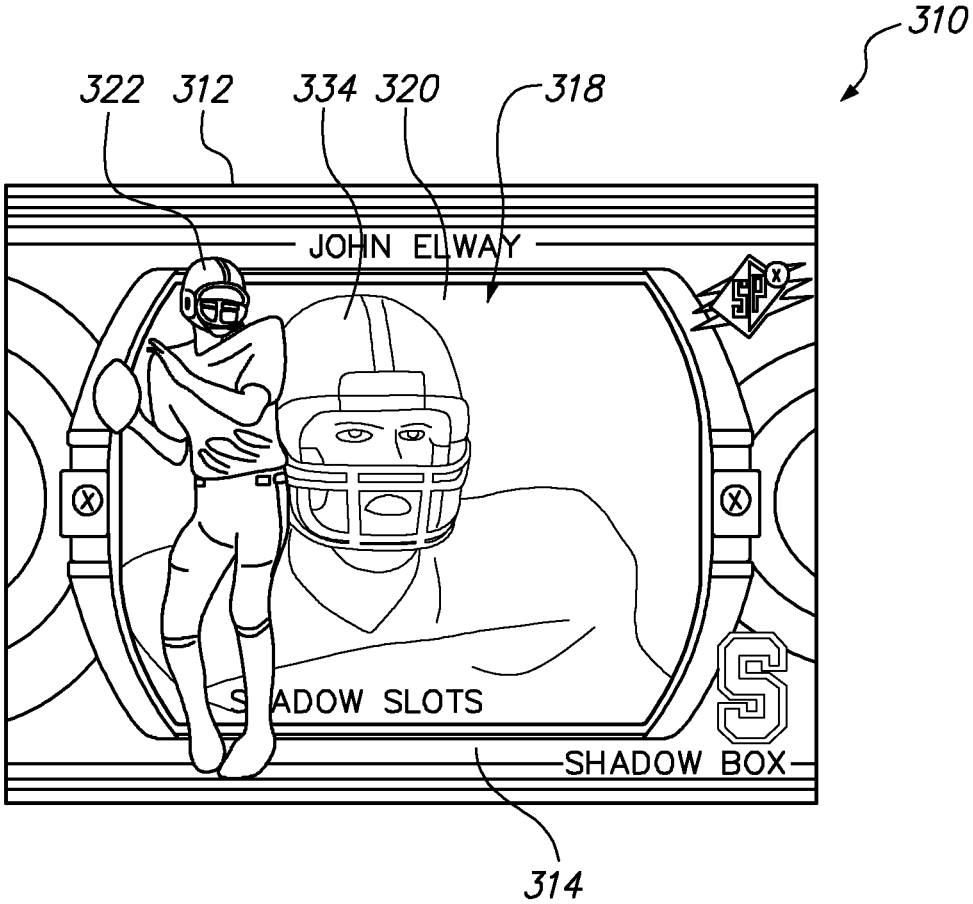
FIG. 3E is a front view of the trading card of FIG. 3A, with the card insert positioned fully within the card slot.

Moreover, as illustrated, the back 326 and the cover 328 can each include a notch 332 so as to enable the user to easily grasp the card insert 320 when the card insert 320 is positioned fully within the cutout 330 of the slot region 318 (as shown In FIG. 3E). Alternatively, in certain embodiments, only one of the back 326 and the cover 328 can include such a notch 332, or neither the back 326 nor the cover 328 can include such a notch 332.

In certain embodiments, the one or more card inserts 320 are sized and shaped to interchangeably and alternatively slide and fit snugly within the slot region 318. Additionally, in one embodiment, the trading card 310 can include more than one card insert 320 to enable the user or owner to vary the overall look of the trading card 310 as desired. For example, the user may be able to insert a new image of a player if and when a player gets traded from one team to another. With a larger number of card inserts 320, the user or owner of the trading card 310 has greater latitude in determining the specific design that is desired for the trading card at any given time.

Additionally, each of the card inserts 320 can include an insert image 334 that is positioned on the card insert 320. In different embodiments, the insert image 334 can cover some, most or substantially all of the surface of the card insert. In certain non-exclusive examples, the insert image 334 can include one or more of a sports athlete, a celebrity, an entertainer, statistics, a team logo, a game field or arena, an image used in a game, an animated character or characters, an autograph or signature, an animal or a landscape.

Moreover, in certain embodiments, each of the card inserts 320 can be made from PVC, clear plastic or some other transparent material. Alternatively, the card inserts 320 may be made from another material, that need not be transparent.

FIG. 3C is a front view of the trading card 310 of FIG. 3A. In particular, FIG. 3C is a front view of the trading card 310 of FIG. 3A, with the card insert 320 positioned partially within the slot region 318 of the card body 312.

FIG. 3D is a perspective view of the trading card 310 of FIG. 3A. In particular, FIG. 3D is a perspective view of the trading card 310 of FIG. 3A, with the card insert 320 positioned partially within the slot region 318 of the card body 312. Additionally, FIG. 3D more clearly illustrates the cutout 330 of the slot region 318 being positioned at least substantially between the back 326 and the cover 328. Moreover, FIG. 3D more clearly illustrates the card insert 320 being slid within the cutout 330 of the slot region 318.

FIG. 3E is a front view of the trading card 310 of FIG. 3A. In particular, FIG. 3E is a front view of the trading card 310 of FIG. 3A, with the card insert 320 positioned fully within the slot region 318 of the card body 312. As illustrated in FIG. 3E, in this embodiment, the unique design of the trading card 310 demonstrates more clearly how depth can be shown between the first card image 322 shown on the first side 314 of the card body 312 and the insert image 334 shown on the card insert 320. Moreover, as shown, the first card image 322 and the insert image 334 can somewhat overlap one another thereby demonstrating the depth between the images 322, 334.

While a number of exemplary aspects and embodiments of a trading card 10, 210, 310 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A trading card that is collectible by one or more users, the trading card comprising:

a card body including a first side, an opposed second side, and a first slot region that is formed into at least one of the first side and the second side, the card body including a card image imprinted thereon;

wherein the card body further includes a second slot region, a first card insert that is selectively positioned within the first slot region, the first card insert including an insert image that relates to a subject in the card image; and a second card insert that is selectively positioned within the second slot region.

2. The trading card of claim 1 further comprising a second card insert that is selectively positioned within the first slot region.

3. The trading card of claim 2 wherein each of the first card insert and the second card insert are alternatively positioned within the first slot region.

4. The trading card of claim 1 wherein the first card insert is interchangeably positioned within one of the first slot region and the second slot region, and wherein the second card insert is interchangeably positioned within the other of the first slot region and the second slot region.

5. The trading card of claim 1 wherein the first slot region is formed into the first side of the card body and the second slot region is formed into the second side of the card body.

6. The trading card of claim 1 wherein the card body further includes a third slot region and a fourth slot region, and further comprising a third card insert and a fourth card insert, and wherein (i) the first card insert is selectively positioned within one of the slot regions, (ii) the second card insert is selectively positioned within another of the slot regions, (iii) the third card insert is selectively positioned within still another of the slot regions, and (iv) the fourth card insert is selectively positioned within the remaining of the slot regions.

7. A trading card that is collectible by one or more users, the trading card comprising:

a card body including a first side, an opposed second side, and a first slot region that is formed into at least one of the first side and the second side, the card body including a card image imprinted thereon; wherein the subject in the card image is one of a sports athlete, a celebrity or an entertainer;

a first card insert that is selectively positioned within the first slot region, the first card insert including an insert image that relates to a subject in the card image, and wherein the insert image includes a signature of the subject.

8. A trading card that is collectible by one or more users, the trading card comprising:

a card body including a first side, an opposed second side, and a first slot region that is formed into at least one of the first side and the second side, wherein the first slot region includes a back, a cover and a cutout that is positioned substantially between the back and the cover; wherein the cover is formed from a substantially transparent material; and a first card insert that is selectively positioned within the first slot region, wherein the first card insert is selectively positioned within the cutout between the back and the cover.

9. The trading card of claim 8 wherein the card body includes a card image imprinted thereon, and wherein the first card insert includes an insert image that relates to a subject in the card image.

10. The trading card of claim 8 wherein the cutout has a cutout thickness, and wherein the first card insert has an insert thickness that is substantially equal to the cutout thickness.

11. A trading card that is collectible by one or more users, the trading card comprising:

a card body including a first side, an opposed second side, a first slot region that is formed into at least one of the first side and the second side, and a second slot region that is formed into at least one of the first side and the second side, the card body including a first card image and a second card image imprinted thereon; a first card insert that is selectively positioned within one of the first slot region and the second slot region, the first card insert including a first insert image that relates to a first subject in the first card image; and a second card insert that is selectively positioned within the other of the first slot region and the second slot region, the second card insert including a second insert image that relates to a second subject in the second card image.

12. The trading card of claim 11 wherein the first slot region is formed into the first side of the card body and the second slot region is formed into the second side of the card body.

13. The trading card of claim 11 wherein the card body further includes a third slot region and a fourth slot region, and further comprising a third card insert and a fourth card insert, and wherein (i) the first card insert is selectively positioned within one of the slot regions, (ii) the second card insert is selectively positioned within another of the slot regions, (iii) the third card insert is selectively positioned within still another of the slot regions, and (iv) the fourth card insert is selectively positioned within the remaining of the slot regions.

14. The trading card of claim 11 wherein (i) the first subject in the first card image is one of a sports athlete, a celebrity or an entertainer, and the first insert image includes a signature of the first subject; and (ii) the second subject in the second card image is one of a sports athlete, a celebrity or an entertainer, and the second insert image includes a signature of the second subject.

15. A trading card that is collectible by one or more users, the trading card comprising:

a card body including a first side, an opposed second side, a first slot region that is formed into at least one of the first side and the second side, and a second slot region that is formed into at least one of the first side and the second side, wherein at least one of the slot regions includes a back, a cover and a cutout that is positioned substantially between the back and the cover;

a first card insert that is selectively positioned within one of the first slot region and the second slot region, wherein the first card insert is selectively positioned within the cutout between the back and the cover; and a second card insert that is selectively positioned within the other of the first slot region and the second slot region.

16. The trading card of claim 15 wherein the card body includes a first card image and a second card image imprinted thereon, wherein the first card insert includes a first insert image that relates to a first subject in the first card image, and wherein the second card insert includes a second insert image that relates to a second subject in the second card image.

17. The trading card of claim 15 wherein the cover is formed from a substantially transparent material.

18. A trading card that is collectible by one or more users, the trading card comprising:

a card body including (i) a first side, (ii) an opposed second side, (iii) a first slot region that is formed into the first side, (iv) a second slot region that is formed into the second side, (v) a first card image that is imprinted on the first side, the first card image including a first subject, and (vi) a second card image that is imprinted on the second side, the second card image including a second subject;

a first card insert that is selectively positioned within one of the first slot region and the second slot region, the first card insert including a first insert image that relates to at least one of the first subject and the second subject; and a second card insert that is selectively positioned within the other of the first slot region and the second slot region, the second card insert including a second insert image that relates to at least one of the first subject and the second subject.

* * * * *